US009739286B2

(12) United States Patent
Tazioli et al.

(10) Patent No.: US 9,739,286 B2
(45) Date of Patent: Aug. 22, 2017

(54) MODULAR STORAGE BASE FOR PUMPING DEVICES

(71) Applicant: DAB PUMPS S.P.A., Mestrino (IT)

(72) Inventors: Stefano Tazioli, Localita Gabbro (IT); Francesco Sinico, Montecchio Maggiore (IT); Riccardo Dal Canto, Leghorn (IT)

(73) Assignee: DAB PUMPS S.P.A., Mestrino (IT)

( * ) Notice: Subject to any disclaimer, the term of this patent is extended or adjusted under 35 U.S.C. 154(b) by 456 days.

(21) Appl. No.: 14/191,160

(22) Filed: Feb. 26, 2014

(65) Prior Publication Data

US 2014/0251124 A1 Sep. 11, 2014

(30) Foreign Application Priority Data

Mar. 8, 2013 (IT) ..... PD2013A0058

(51) Int. Cl.
*F04D 29/60* (2006.01)
*F04B 1/04* (2006.01)
(Continued)

(52) U.S. Cl.
CPC ..... *F04D 29/60* (2013.01); *F04B 1/0404* (2013.01); *F04B 53/16* (2013.01); *F04B 53/22* (2013.01)

(58) Field of Classification Search
CPC ..... F04B 1/0404; F04B 39/14; F04B 53/16; F04B 53/22; F04D 26/40; F04D 29/406;
(Continued)

(56) References Cited

U.S. PATENT DOCUMENTS 3,191,544 A 6/1965 Otto Szekely
4,554,700 A * 11/1985 Lyman ..... A47L 9/00 15/323
(Continued)

FOREIGN PATENT DOCUMENTS

CN 101571136 A 11/2009
CN 102072130 A * 5/2011 ..... E03B 5/02
(Continued)

OTHER PUBLICATIONS

English Translation of CN 102072130 A (Lin) published May 2011 obtained from ProQuest.*
(Continued)

*Primary Examiner* — Dominick L Plakkoottam
*Assistant Examiner* — Connor Tremarche
(74) *Attorney, Agent, or Firm* — Koppel, Patrick, Heybl & Philpott

(57) ABSTRACT

A base for pumping devices, the base comprising at least one module with which it is possible to mate one pumping device, the module comprising an intake connector and a delivery connector in order to connect respectively the intake and the delivery of the pumping device respectively to a first tubular element and to a second tubular element to which they are essentially perpendicular, the two tubular elements, the first one and the second one, passing through the base from a first lateral face thereof to an opposite second lateral face thereof, from which they face outward in order to be connected, selectively at either face, to a hydraulic system.

11 Claims, 6 Drawing Sheets

(51) Int. Cl.
*F04B 53/16* (2006.01)
*F04B 53/22* (2006.01)

(58) Field of Classification Search
CPC ..... F04D 29/403; F04D 29/60; F04D 29/605; F04D 29/426; F04D 29/4293; F04D 29/607; F04C 2230/604; F04C 2230/70; F04C 2230/80
USPC ..... 417/360, 361
See application file for complete search history.

(56) References Cited

U.S. PATENT DOCUMENTS

| | | | | |
|---|---|---|---|---|
| 6,568,919 | B1 | 5/2003 | Fletcher et al. | |
| 2003/0143085 | A1* | 7/2003 | Fletcher | F04B 53/06 417/307 |
| 2006/0273583 | A1* | 12/2006 | Cronley | F16L 25/009 285/331 |
| 2011/0182754 | A1* | 7/2011 | Gathers | F02B 63/04 417/234 |

FOREIGN PATENT DOCUMENTS

| | | | |
|---|---|---|---|
| EP | 2489790 | A2 | 8/2012 |
| WO | WO 01/09513 | A1 | 2/2001 |

OTHER PUBLICATIONS

Italian Search Report for IT PD20130058 dated Sep. 17, 2013.
First Office Action from corresponding Chinese Patent Appl. No. 201410083432.3, dated Feb. 4, 2017.

* cited by examiner

MODULAR STORAGE BASE FOR PUMPING DEVICES

The present invention relates to a base for pumping devices.

BACKGROUND OF THE INVENTION

As is known, the installation of a pumping device is required where it is necessary to supply a hydraulic system.

The device, the main components of which are substantially an electric pump, an inverter that drives it and an accumulation tank that acts as a plenum chamber for the delivery, is connected with the intake and delivery to portions of the system according to configurations that are often scarcely flexible from an operating standpoint.

Such pumping devices can be assembled on site during installation, by associating their components purchased from one or more suppliers, or can be purchased in already-assembled units, ready for installation.

The latter have the obvious advantage of facilitating and especially speeding up the installation operations, and optionally, if this is provided by the device type, lend themselves to be installed with the axis of the electric pump arranged horizontally or vertically as needed.

However, connecting portions of the system to the intake and delivery ports of the device very often requires long connectors and connecting means, such as for example flanges, screws and bolts, the use of which prolongs the installation operations and entails useless space occupations. For example, it may be necessary to connect the system to the intake of the device on one side of the latter and the delivery on the opposite side, or on a side that is contiguous to the first one.

Furthermore, the operations for connecting the intake and delivery connectors to the hydraulic system often are not only long and labor-intensive but must also be repeated both during installation and during maintenance operations.

These drawbacks are even more evident when the supply of the hydraulic system requires the installation of multiple pumping devices to be connected in order to ensure the design flow-rates and head.

Another drawback is due to the fact that in case of malfunction the device cannot always be repaired in a short time and sometimes must be taken to the support service, interrupting the functionality of the system.

SUMMARY OF THE INVENTION

The aim of the present invention is to provide a base for pumping devices that allows to connect flexibly their intake and delivery to the hydraulic system.

Within this aim, an object of the invention is to facilitate the operations for installing and maintaining the pumping device and to reduce their time.

Another object of the invention is to ensure the continuity of operation of the hydraulic system.

This aim, as well as these and other objects that will become better apparent hereinafter, are achieved by a base for pumping devices, characterized in that it comprises at least one module with which it is possible to mate one of said pumping devices, said module comprising an intake connector and a delivery connector in order to connect respectively the intake and the delivery of said pumping device respectively to a first tubular element and to a second tubular element to which they are substantially perpendicular and which pass through said base from a first lateral face thereof to an opposite second lateral face thereof, from which they face outward in order to be connected, selectively at either face, to a hydraulic system.

BRIEF DESCRIPTION OF THE DRAWINGS

Further characteristics and advantages of the invention will become better apparent from the description of a preferred but not exclusive embodiment of the base according to the invention, illustrated by way of nonlimiting example in the accompanying drawings, wherein.

DESCRIPTION OF THE PREFERRED EMBODIMENTS

Figure 2:
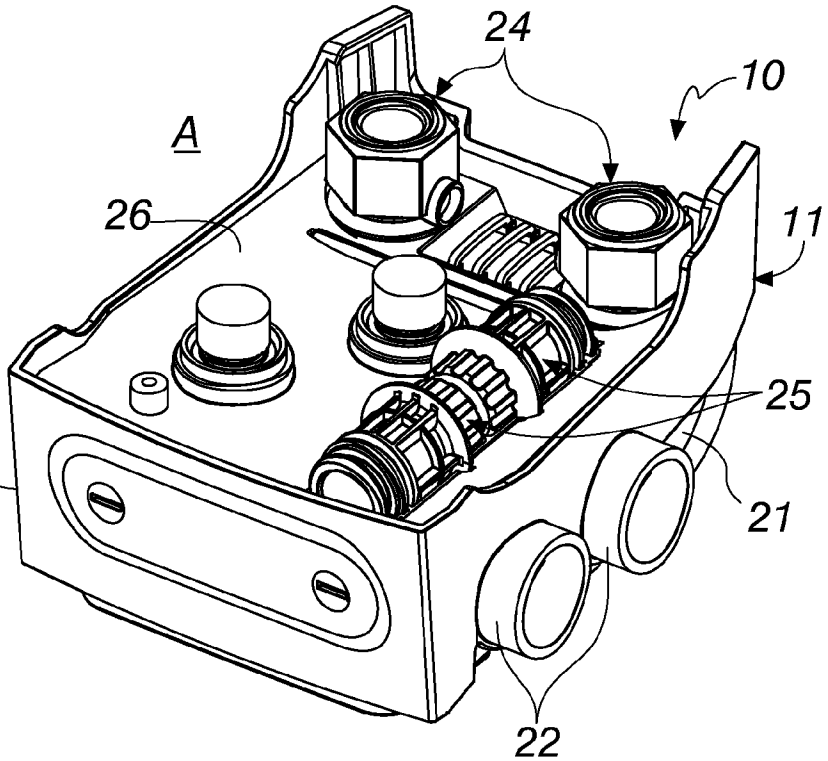
FIG. 2 is a perspective view of the base according to the invention, again in the first embodiment and in the inactive configuration.
Figure 1:
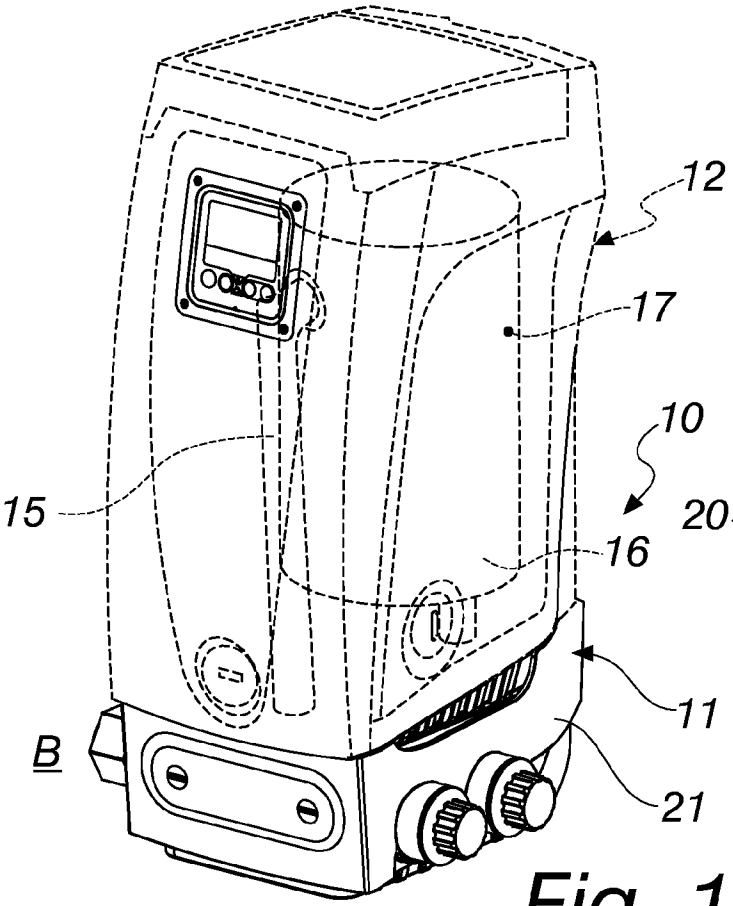
FIG. 1 is a perspective view of the base according to the invention in a first embodiment, coupled to a pumping device.

With reference to the first six figures, the base according to the invention, designated in its first embodiment by the reference numeral 10, comprises a single module 11 by means of which it is possible to mate a pumping device 12.

The first figure shows, as mentioned, the base 10 mated to a pumping device 12, while in other subsequent figures the base 10 is shown on its own to indicate its individual components and their association.

In particular, FIG. 2 shows the base 10 in the inactive configuration A, i.e., in the configuration in which it is proposed to the buyer prior to mating with the pumping device 12.

Figures 3, 4:
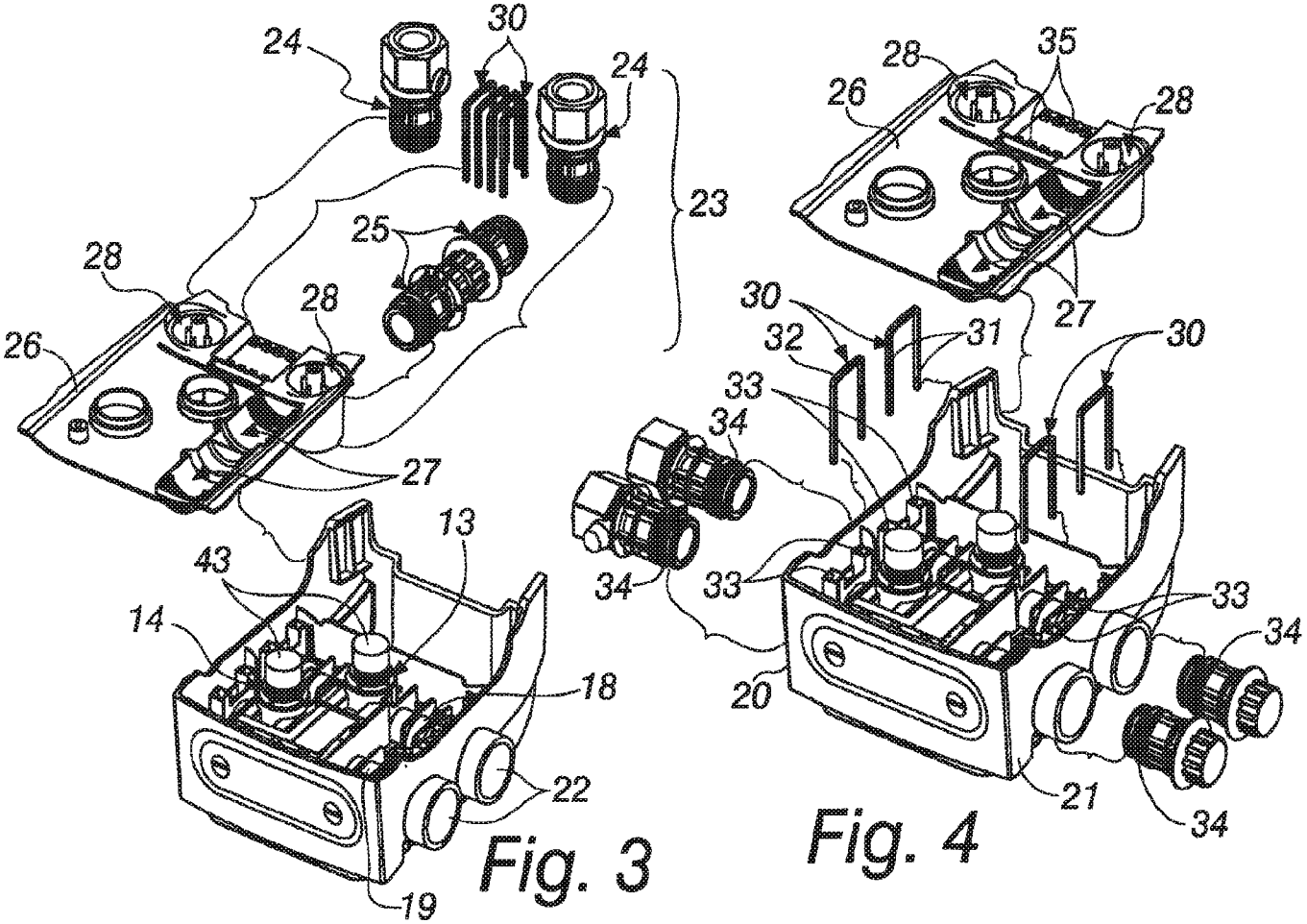
FIG. 3 is an exploded perspective view of the base according to the invention in the first embodiment.
FIG. 4 is same perspective view of the preceding figure of the base according to the invention during a step of assembly in the active configuration.
Figure 5:
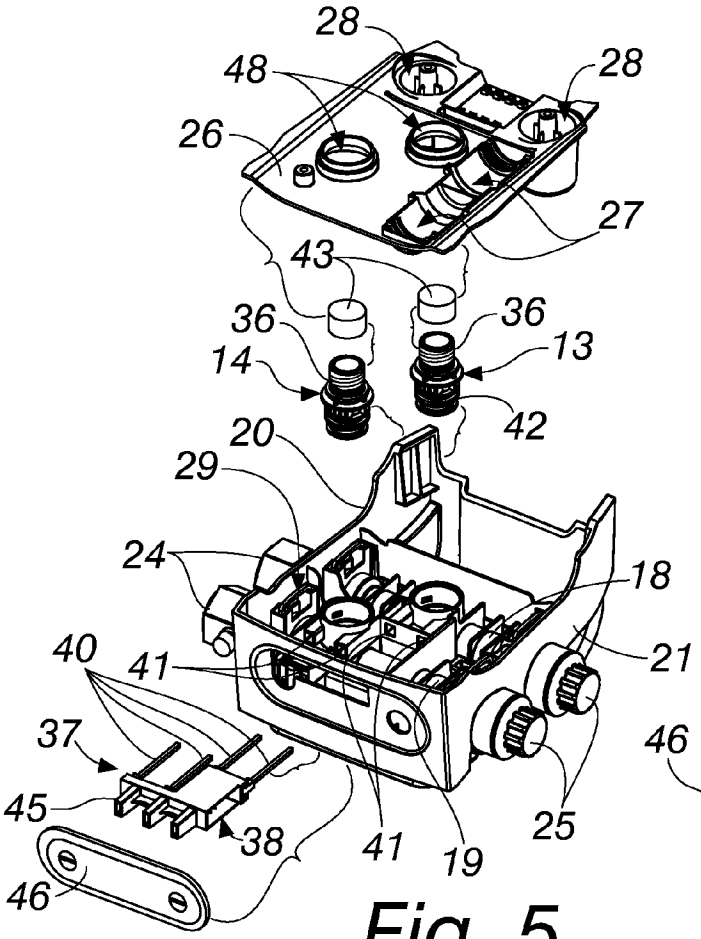
FIG. 5 is a view, similar to the preceding figure, of another step of the assembly of the base according to the invention in the active configuration.

In FIG. 3, instead, the base 10 is shown in a view that is almost completely exploded and in which one can see, even more so in FIG. 5, that it comprises an intake connector 13 and a delivery connector 14 that are meant to connect respectively the intake 15 and the delivery 16 of a pump 17 of the pumping device 12 to a first tubular element 18 and a second tubular element 19 to which they are substantially perpendicular. The two tubular elements 18 and 19 pass through the base 10 (in practice the module 11 in this embodiment) from a first lateral face 20 thereof to an opposite second lateral face 21 thereof, from which they face outward, protruding from them each with a stub 22 for each side, so that they can be connected, selectively at either face, to a hydraulic system.

The module 11 accommodates an apparatus 23, designated by this reference numeral in FIG. 3, which comprises two connectors 24 for the connection of the base 10, or in this case directly of the module 11 proper, to the hydraulic system. One of the two connectors 24 is in fact to be associated, for the assembly of the base 10 in the active configuration B, with the first tubular element 18, the other one with the second tubular element 19, selectively, at one of the two lateral faces, the first one 20 or the second one 21, each one entering a stub 22.

The apparatus 23 also comprises a pair of plugs 25 by means of which the remaining openings of the two tubular elements 18 and 19 are to be closed, inserting them, too, again at the lateral faces 20 and 21, in the remaining stubs 22.

As clearly visible from the exploded figures, the module 11 has a substantially boxlike shape.

It accommodates internally the two tubular elements, the first one 18 and the second one 19, with the respective intake connector 13 and delivery connector 14, and can be closed, in the inactive configuration A of the base 10, with a lid 26 that has, on the outer side, two adjacent accommodation compartments 27 for the two plugs 25 and two separate accommodation seats 28 for the two connectors 24, clearly visible in FIGS. 3, 4 and 5.

From said figures it can be noticed that the apparatus 23 comprises advantageously also means for quick and reversible connection, which consist of four U-shaped forks 30, in order to fix integrally the connectors 24 and the plugs 25 to the openings of the first tubular element 18 and of the second tubular element 19.

In particular, as can be seen from the assembly step shown in FIG. 4, each one of the forks 30 is inserted with two parallel arms 31, which extend from a cross-member 32 of the fork 30, in a direction that is perpendicular to the longitudinal direction of the first tubular element 18 and of the second tubular element 19, in adapted first pairs of seats 33 that intersect a circular groove 34 provided on the end portions with which the connectors 24 and the plugs 25 enter the tubular elements, the first one 18 and the second one 19, at the two opposite lateral faces, the first one 20 and the second one 21 of the base 10.

The cover 26 advantageously has four pairs of holes 35 in which the four forks 30 are inserted in the inactive configuration A, prior to the assembly of the base 10 for mating with the pumping device 12.

As shown in FIG. 5, the intake connector 13 and the delivery connector 14 have an end portion 36 that is threaded and by means of which they are screwed onto the intake and delivery of the pump 17 of the pumping device 12, in particular to the intake port and to the delivery port, which are not visible because they are located on the wall of the pumping device 12, which is located downward with respect to the illustrations.

On the opposite side, the intake connector 13 and the delivery connector 14 are joined to the two tubular elements, the first one 18 and the second one 19, by way of adapted locking means 37, which consist substantially of a comb-like element 38, which is inserted from a third lateral face 39 of the module 11 in order to enter, transversely to the intake connector 13 and the delivery connector 14, with four teeth 40 having the same length in pairs within adapted second pairs of seats 41 of the module 11, each pair of which affects a corresponding circular slot 42 that surrounds the intake connector 13 and one that surrounds the delivery connector 14.

The intake connector 13 and the delivery connector 14 are provided conveniently with thread protecting plugs 43 fitted on the end portions 36 in the inactive configuration A of the module 11, prior to their association with the intake and delivery of the pumping device 12.

Figure 6:
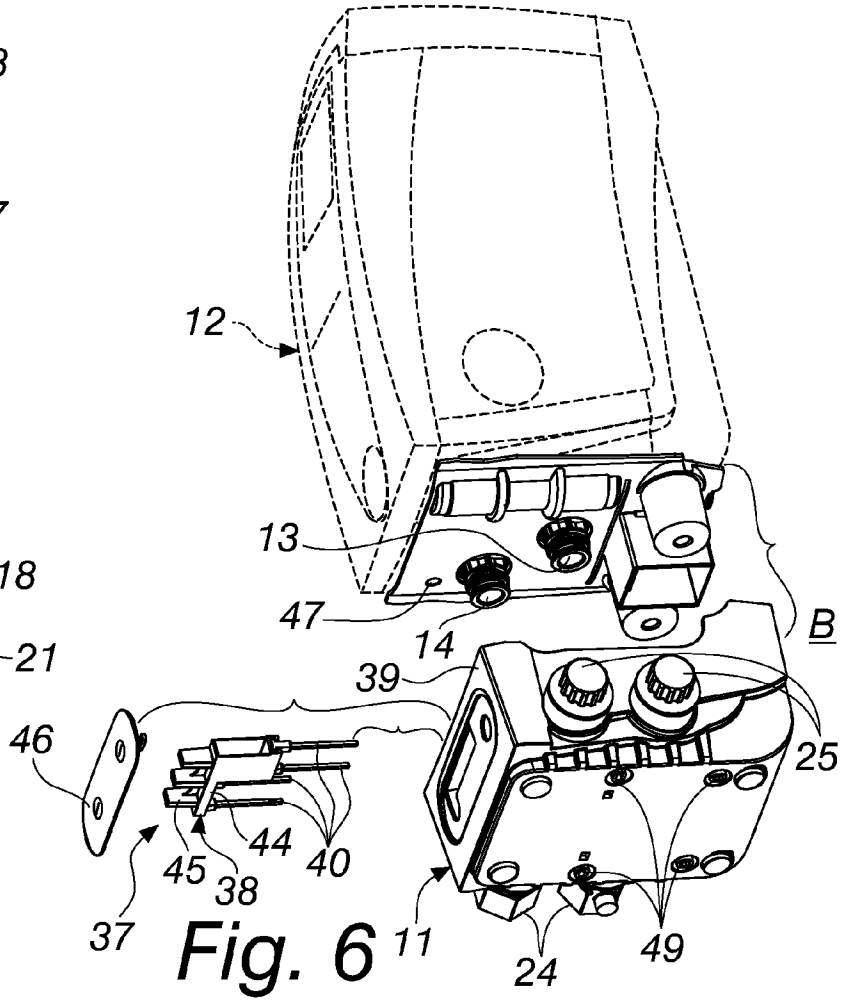
FIG. 6 is another perspective view of the mating of a pumping device with a base according to the invention.

As can be seen in FIG. 5 and in FIG. 6, the comb-like element 38 comprises a base 44 from which the teeth 40 protrude in the direction of insertion in the module 11, while on the opposite side it has grip protrusions 45 for its extraction and for its insertion. When the comb-like element 38 is inserted in the module 11, it is advantageously hidden inside by means of a covering plate 46.

FIG. 6 is a perspective view from below of the mating of the pumping device 12 with the module 11. It is evident that the mating is preceded by the association of the lid 26 with the wall of the pumping device 12 at which the intake port and the delivery port are present. The lid 26 in fact conveniently has two holes 47, of which only one is visible, for fixing to the device by means of screws, and two windows 48, shown in the exploded view of FIG. 5 to facilitate comprehension, through which the intake connector 13 and the delivery connector 14 are screwed with their end portions 36 respectively in the intake port and in the delivery port of the pumping device 12.

FIG. 6 also shows four through holes 49 for fixing by means of other adapted screws to a footing or to a supporting structure.

In the second embodiment, the base is shown in the subsequent FIGS. 7 to 11, where it is generally designated by the reference numeral 110.

According to this embodiment, it comprises two modules 111 arranged side by side in series, each intended to allow coupling to a pumping device 112. Each module 111 is therefore provided conveniently with an intake connector 113 and with a delivery connector 114 in order to connect respectively the intake and the delivery of the pumping device 112 associated therewith with a first tubular element 118 and with a second tubular element 119.

Figure 7:
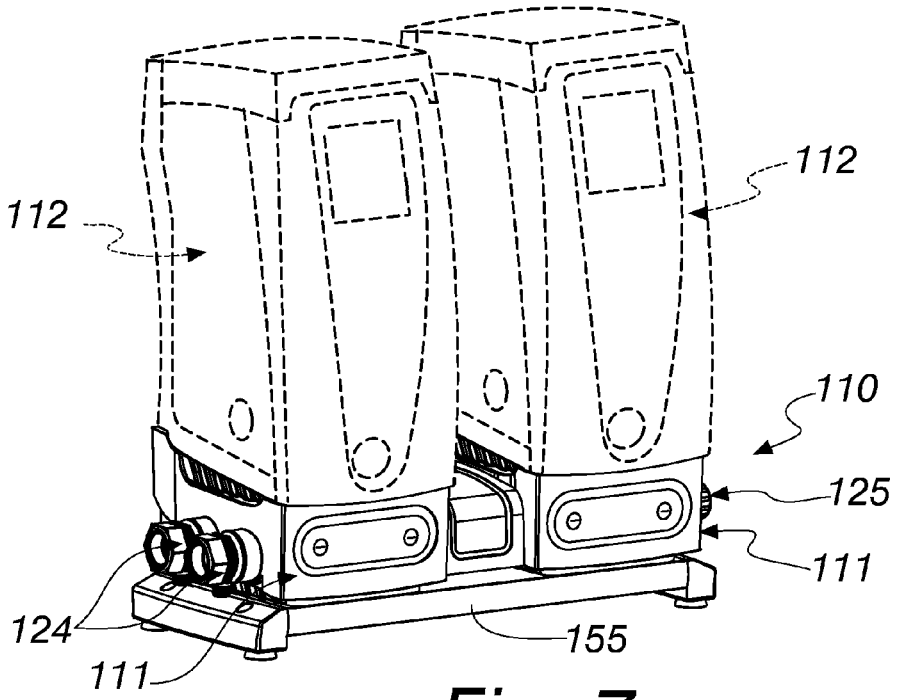
FIG. 7 is a perspective view of the base according to the invention in a second embodiment provided with two modules that are coupled to two pumping devices.

FIG. 7 is a view of the base 110 with the two modules 111 in series, each coupled to a pumping device 112 and ready to be connected to a hydraulic system.

Figure 8:
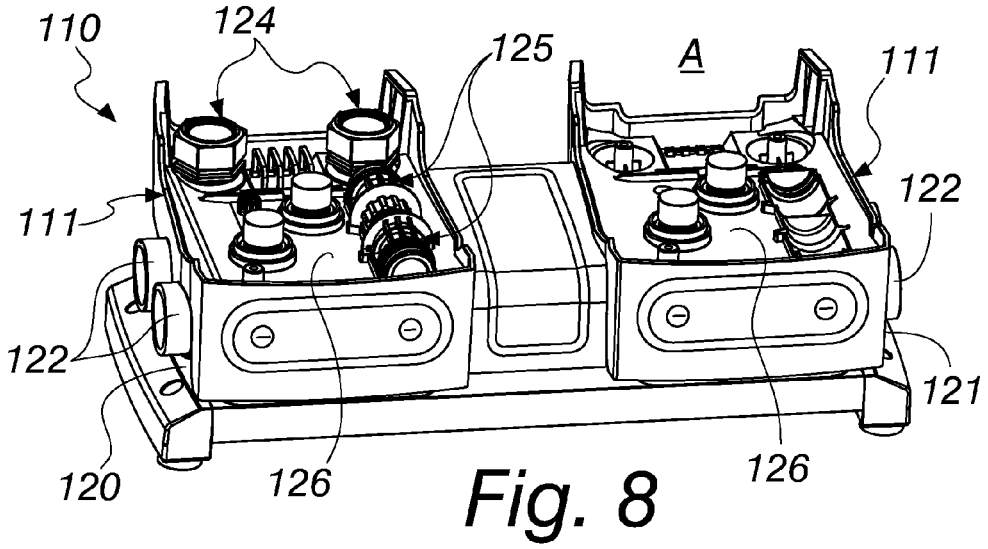
FIG. 8 is a perspective view of the base according to the invention, again in the second embodiment and in the inactive configuration.

The subsequent FIG. 8 instead shows the base 110 in the inactive configuration A, prior to mating with the pumping devices 112.

Figure 9:
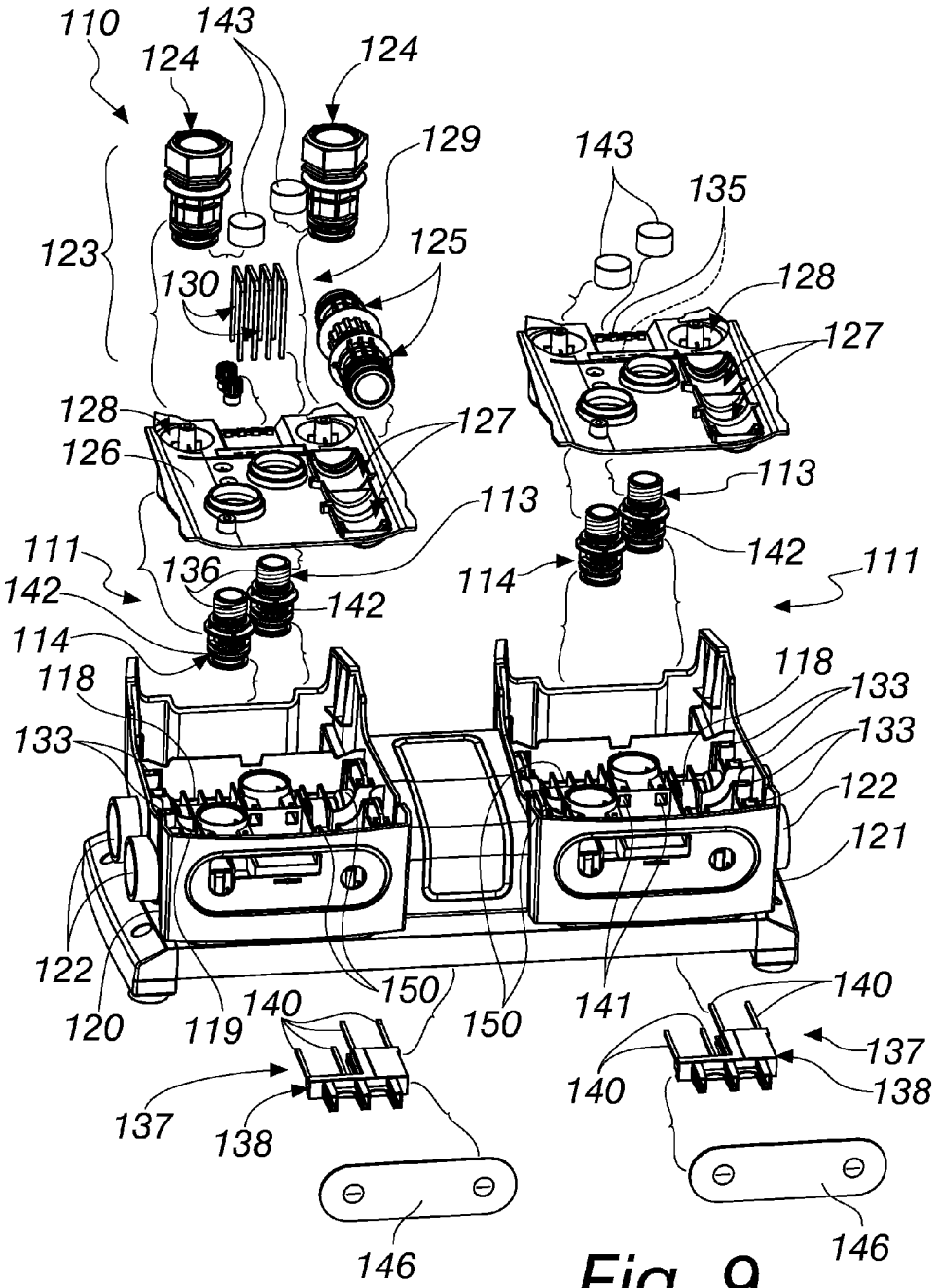
FIG. 9 is an exploded perspective view of the base according to the invention in the second embodiment.

In FIG. 9, the base 110 is shown with the modules 111 in exploded view, showing how each one of them is provided, as anticipated, with an intake connector 113 and with a delivery connector 114, both of which are threaded at the end portion 136 in order to be screwed to the intake port and to the delivery port of the pumping device 112, so as to be able to connect the latter to a first tubular element 118 and to a second tubular element 119, to which they are substantially perpendicular.

Both the intake connector 113 and the delivery connector 114 are conveniently provided with thread protecting plugs 143 that are fitted on said end portions 136 when the base 110 is in the inactive configuration A, therefore when they are not yet connected to the intake and to the delivery of the pumping device 112 (as in FIG. 8). As illustrated and described for the preceding embodiment, on the opposite side with respect to the end portion 136 the intake connector 113 and the delivery connector 114 are joined to the two tubular elements 118 and 119 by way of adapted locking means 137, described hereinafter.

The two tubular elements 118 and 119 pass through the base 110, passing then in series through the two modules 111, in order to face the outside of the base 110, protruding from the first lateral face 120 and from the second lateral face 121 with a stub 122 on each side.

Figure 10:
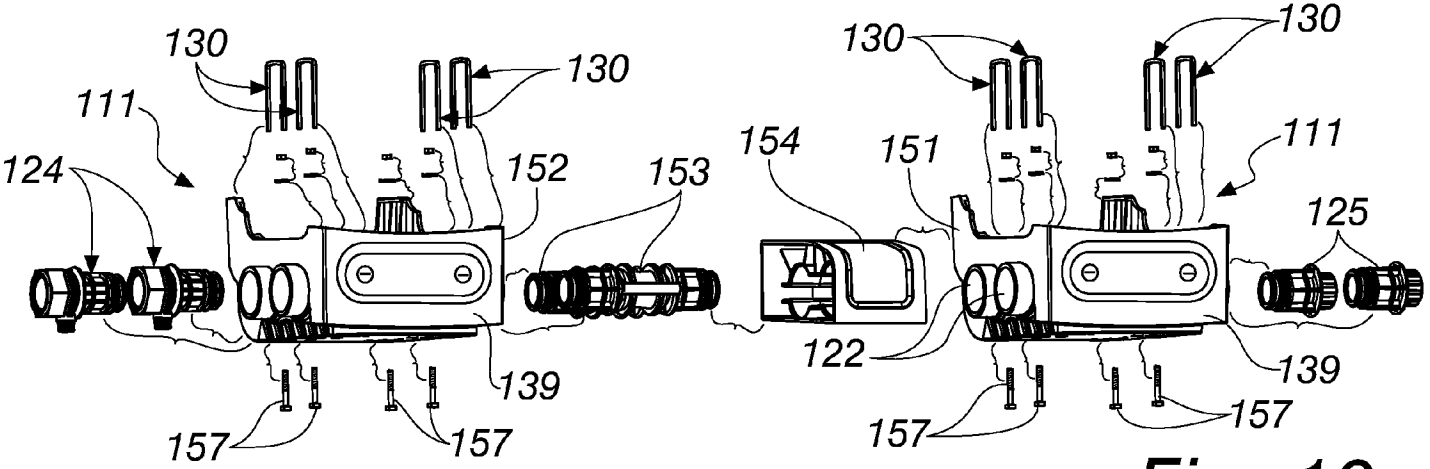
FIG. 10 is a partially exploded perspective view of the base according to the invention.

The first tubular element 118 and the second tubular element 119 comprise, for each of the modules 111, respective portions 150 for distributing the liquid, which pass through the module 111 from a first side wall 151 thereof to an opposite second side wall 152 thereof and are mutually connected from one of the modules 111 to the next by means of connecting portions 153, shown in FIG. 10, which enter the two stubs 122 that protrude from the second side wall 152 of the first of the modules 111 and from the first side wall 151 of the second of the two modules 111, so as to constitute, together with the distribution portions 150, the two tubular elements 118 and 119. As can be seen in the exploded view of FIG. 10, the connecting portions are inserted in a protection and covering enclosure 154.

Conveniently, only one of the two modules 111 is provided with the apparatus 123, which comprises two connectors 124 for the connection of the base 110 to the hydraulic system. One of the two connectors 124 is associated with the first tubular element 118, the other one being associated with the second tubular element 119, each one entering a stub 122, selectively at one of the two lateral faces of the base 110, the first one 120 corresponding substantially to the first side wall 151 of a module 111, the second one 121 corresponding substantially to the second side wall 152 of the other module 111.

The apparatus 123 also comprises a pair of plugs 125 by means of which the remaining openings of the two tubular elements 118 and 119 are closed, inserting them, too, again at the lateral faces 120 and 121, in the remaining stubs 122.

Each one of the modules 110, as in the preceding embodiment, has a substantially boxlike shape and accommodates internally the distribution portions 150 of the two tubular elements, the first one 118 and the second one 119, with the respective intake connector 113 and delivery connector 114, and can be closed, in the inactive configuration A of the base 110, with a lid 126.

In this embodiment also, the cover 126 has, on the outer side, two adjacent accommodation compartments 127 for the two plugs 125 and two distinct accommodation seats 128 for the two connectors 124. Only for one of the two modules 111 the accommodation compartments 127 and the accommodation seats 128 are occupied by two connectors 124 and by two plugs 125.

The apparatus 123 also comprises means 129 for quick and reversible connection, which consist of four U-shaped forks 130, in order to lock integrally the connectors 124 and the plugs 125 to the openings of the first tubular element 118 and of the second tubular element 119, as in the preceding embodiment, in order to provide the assembly in the active configuration B.

In particular, each one of the U-shaped forks 130 is inserted with two parallel arms 131, which extend from a crossmember 132 of said fork 130, in a direction that is at right angles to the longitudinal direction of the first tubular element 118 and of the second tubular element 119, in adapted first pairs of seats 133 that intersect a circular groove 134 that is provided on the end portions with which the connectors 124 and the plugs 125 enter the first tubular element 118 and the second tubular element 119 at the two opposite lateral faces 120 and 121 of the base 110.

The lid 126 has four pairs of holes 135 in which the U-shaped forks 130 are inserted in the inactive configuration A, as shown with the first module on the left of FIG. 8.

In the second embodiment, the base 110 is provided with four additional forks 130, which lock the distribution portions 150 to the connecting portions 153. These four forks 130 are already inserted in the respective seats and are used in the same manner described for the preceding ones.

In addition to the quick and reversible connection means 129, the base 110 is also provided with the above cited locking means 137. Said means consist substantially of a comb-like element 138, which is similar to the one described in the previous embodiment and also is hidden inside the module 111 by means of a covering plate 146. As before, the comb-like element 138 is inserted from a third lateral face 139 of the module 111 in order to be inserted, transversely to the intake connector 113 and delivery connector 114, with four teeth 140, having the same length in pairs, in adapted second pairs of seats 141 of the module 111, each pair of which affects a corresponding circular slot 142 that surrounds the intake connector 113 and one that surrounds the delivery connector 114.

According to this embodiment, the base 110 can comprise, as in the illustrated case, a footing 155, preferably a profiled element made of aluminum, for at least one pair of modules 111, with which they are associated by way of adapted connecting means 156.

Figure 11:
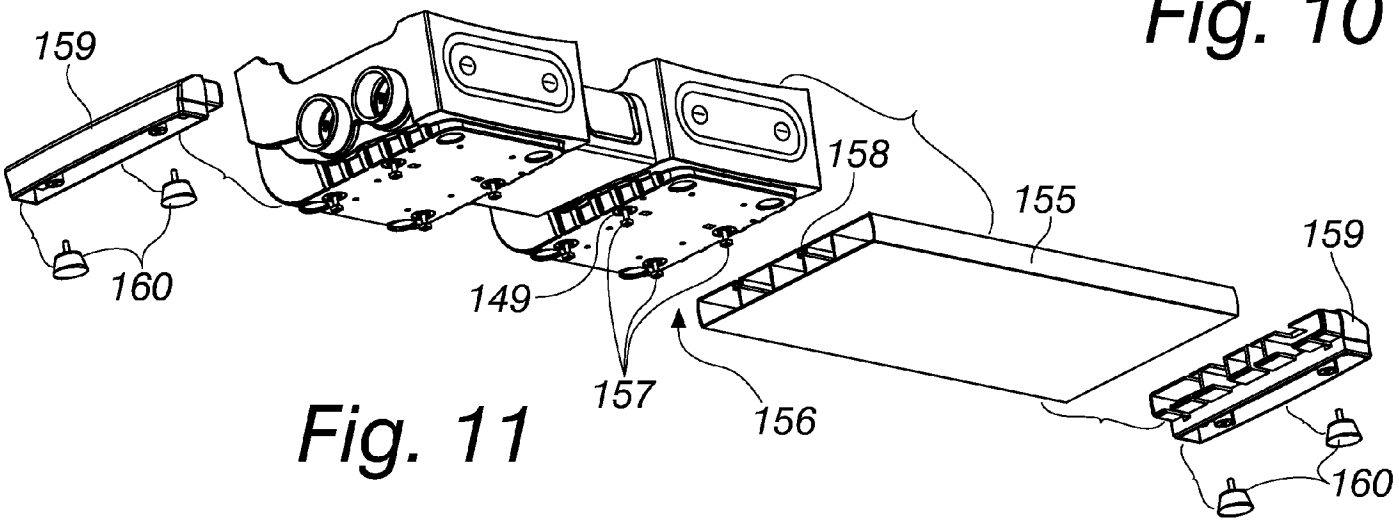
FIG. 11 is a perspective bottom view of the assembly of the base, in the second embodiment, on a footing.

In FIG. 11, the base 110 is shown with a perspective view from below. Whereas in the previous embodiment some screws are inserted from the inside of the module 11 into the through holes 49 in order to fix the base 10 to a supporting structure, in this second embodiment the screws, shown and designated herein by the reference numeral 157, are inserted from below, therefore from the outside of the modules 111, into the through holes 149.

The footing 155 is approximately as long as the base 110 and is provided in an upward region with two tracks 158, inside which the heads of the screws 157, which protrude from the bottom of each module 111, are made to slide. The tracks 158 conveniently have a reduction in cross-section at the upper surface of the footing.

Moreover, said footing is closed at its ends with two opposite heads 159, each provided with two resting feet 160.

Use of the base according to the invention is as follows.

Both in its first embodiment and in its second embodiment, the base 10 or 110 is proposed in an inactive configuration A and must be assembled in the active configuration B during installation, so that it can be mated with at least one pumping device 12.

In the first embodiment, the base 10 is proposed as a single module 11 in order to be mated to a single pumping device 12.

In the initial operations, the components of the apparatus 23 are extracted from the respective compartments of the lid 26 and said lid is raised as shown in FIG. 3.

The shell of the module 11 is then fixed to a supporting structure by means of four screws that pass through it from the inside outward at the four through holes 49.

The placement of the connectors 24 and of the plugs 25 is then selected according to the provision requirements of the hydraulic system. For example, as shown in FIGS. 4 to 6, the connectors 24 are associated with the first tubular element 18 and with the second tubular element 19 by inserting them in the stubs 22 that protrude from the first lateral face 20 of the module 11, while the two plugs 25 are inserted in the remaining openings, i.e., in the remaining stubs 22 at the second lateral face 21.

The two connectors 24 and the two plugs 25 are then locked to the two tubular elements 18 and 19 by inserting the four forks 30 in the adapted first pairs of seats 33, which intersect the circular grooves 34 of the connectors 24 and of the plugs 25, preventing their extraction. At this point the base 10 is assembled according to the active configuration B and is ready to be mated with the pumping device 12.

The cover 26 is fixed to the wall of the pumping device 12, which supports the intake port and the delivery port, by means of two screws that pass through it at the two holes 47.

The plate 46 is removed by turning with a flat head screwdriver or with a coin two elements that fix it to the third lateral face 39, and the comb-like element 38 is extracted by gripping it by the grip protrusions 45; in this manner the intake connector 13 and the delivery connector 14 are disengaged from the two tubular elements 18 and 19 and can thus be removed from the module 11 and deprived of the thread protecting plugs 43 in order to be screwed to the delivery port and to the intake port of the pumping device 12.

Finally, the pumping device 12 is mated with the base 10 by inserting it with the intake connector 13 and the delivery connector 14 in the adapted openings of the two respective tubular elements, the first one 18 and the second one 19; the base 10 and the pumping device 12 are rendered integral by way of the locking means 37. The corresponding comb-like element 38, by entering with the teeth 40 the two second pairs of seats 41 of the module 11, ensures the connection of the tubular parts.

It should be noted that the lid 26, by duplicating on the lower side the shape of the accommodation seats 27, acts substantially as a centering element for the mating of the pumping device 12.

It should also be noted that in the illustrated example the pumping device 12 is designed to be installed so that the axis of the pump 17 is vertical or horizontal, said axis being perpendicular to the wall of the boxlike containment body at which the intake port and the delivery port are provided. The base 10 can thus be fixed to the floor or to another supporting structure according to two possible positions, which correspond to the vertical installation, such as the illustrated one, or horizontal installation of the pumping device 12.

The use of the base 110 in the connection of each pumping device 112 to the corresponding module 111 is similar to the one that has just been described for the first embodiment.

In this case, the base 110 can be fixed to the wall or to another supporting structure as described for the preceding one, or, exclusively for vertical installation, can be mounted on a footing 155. This operation occurs by screwing from the outside four screws 157 for each module 111 in the through holes 149. Prior to mating with the pumping devices 112, the base 110 is made to slide with the heads of the screws 157 in the two tracks 158. Once the base 110 has been positioned, the nuts of the screws 157 are tightened from the inner side of each module 111, locking the base 110 to the footing 155, and the latter is closed at its ends with the two heads 159.

Although this is not shown for the sake of simplicity, the several parts through which liquid flows are mutually associated by using sealing gaskets, such as gaskets of the O-ring type.

It should be noted that the base, in both proposed versions 10 and 110, can be prepared for installation in the active configuration B with a small number of simple and quick steps in order to accommodate the pumping device 12 or the devices 112.

In practice it has been found that the invention achieves the intended aim and objects, by providing a base that allows to connect one or more pumping devices to a hydraulic system in a flexible way, allowing to provide connections to the intake and delivery on different sides of the device as required, at the same time optionally also positioning the latter so that the axis of the pump is in a horizontal or vertical position.

Moreover, the invention facilitates evidently the operations for installing and maintaining the pumping device. The connections of the several parts that convey liquid do not require the use of different connection means, such as flanges, screws and bolts, reducing considerably the overall space occupation of the apparatus and the time to be dedicated to installation operations.

Furthermore, if the maintenance of the device requires its removal, disassembly operations also are consequently quicker.

Another advantage of the invention resides in that in case of malfunction of the device it can be replaced with a similar device, to be connected rapidly in the described manner, ensuring continuity of operation of the system until the preceding device is repaired.

The invention thus conceived is susceptible of numerous modifications and variations, all of which are within the scope of the inventive concept; all the details may further be replaced with other technically equivalent elements.

In practice, the materials used, so long as they are compatible with the specific use, as well as the contingent shapes and dimensions, may be any according to requirements and to the state of the art.

The disclosures in Italian Patent Application No. PD2013A000058 from which this application claims priority are incorporated herein by reference.

What is claimed is:

1. A base for pumping devices, comprising at least one module which is configured to mate one of said pumping devices, said module comprising an intake connector and a delivery connector in order to connect respectively the intake and the delivery of said pumping device respectively to a first tubular element and to a second tubular element to which they are substantially perpendicular and which pass through said base from a first lateral face thereof to an opposite second lateral face thereof, from which they face outward in order to be connected, selectively at either face, to a hydraulic system;

wherein one of said modules accommodates an apparatus that comprises two connectors for the connection of said base to said hydraulic system, one to be associated with said first tubular element, the other one with said second tubular element, selectively at one of said first and second lateral faces, said apparatus also comprising two plugs for closing remaining openings of said first tubular element and said second tubular element at said first lateral face and at said second lateral face.

2. The base according to claim 1, wherein said module has a substantially boxlike shape that can be closed in an inactive configuration that precedes mating with said pumping device, with a lid that has at least one accommodation compartment for said plugs and two accommodation seats for said connectors.

3. The base according to claim 1, wherein said apparatus comprises a connection configured to associate integrally said plugs and said connectors with said first tubular element and with said second tubular element.

4. The base according to claim 3, wherein said connection consists of at least four U-shaped forks, each to be inserted with two parallel arms that extend from a cross-member of said fork in a direction that is perpendicular to the direction of extension of said tubular elements, the first tubular element and the second tubular element, in adapted first pairs of seats that affect a circular groove provided on the end portions, wherein said connectors and said plugs are inserted in said first and second tubular elements at the two opposite said lateral faces, the first one and the second one, of the base.

5. The base according to claim 1, wherein said first and second tubular elements protrude from said first lateral face and from the opposite said second lateral face of said base, each one with a stub on each side, each one inside which one of said connectors and of said plugs is inserted.

6. The base according to claim 2, wherein said lid has four pairs of holes, in which at least four forks are inserted in the inactive configuration.

7. A base for pumping devices, comprising at least one module which is configured to mate one of said pumping devices, said module comprising an intake connector and a delivery connector in order to connect respectively the intake and the delivery of said pumping device respectively to a first tubular element and to a second tubular element to which they are substantially perpendicular and which pass through said base from a first lateral face thereof to an opposite second lateral face thereof, from which they face outward in order to be connected, selectively at either face, to a hydraulic system;

wherein said intake connector and said delivery connector have a threaded end portion by which they are screwed to the intake and to the delivery of said pumping device, while on the opposite side they are joined to said first and second tubular elements by locking, wherein said locking consists of a comb-like element that is inserted from a third lateral face of said module in order to be inserted, transversely to said intake connector and delivery connector, with four teeth that in pairs have approximately the same length as corresponding second pairs of seats of said module, each of which affects a corresponding circular slot that surrounds said intake connector and said delivery connector.

8. A base for pumping devices, comprising at least one module which is configured to mate one of said pumping devices, said module comprising an intake connector and a delivery connector in order to connect respectively the intake and the delivery of said pumping device respectively to a first tubular element and to a second tubular element to which they are substantially perpendicular and which pass through said base from a first lateral face thereof to an opposite second lateral face thereof, from which they face outward in order to be connected, selectively at either face, to a hydraulic system, said base further comprising at least two of said modules arranged side by side in succession, each to be mated with one of said pumping devices, each one of said modules having said intake connector and said delivery connector by which they connect the intake of the respective pumping device to said first tubular element and the delivery of said pumping device to said second tubular element, said two tubular elements crossing in series said modules and leading onto the outside of said base with at least one stub from said first lateral face and from said opposite second lateral face.

9. The base according to claim 8, wherein one of said modules is provided with an apparatus that comprises two connectors for the connection of said base to said hydraulic system.

10. The base according to claim 8, wherein said first tubular element and said second tubular element comprise, for each one of said modules, respective portions of said first tubular element and said second tubular element for distributing the liquid, which pass through said module from a first side wall thereof to an opposite second side wall thereof, said distribution portions being connected to each other from one of said modules to the next by connecting portions.

11. The base according to claim 8, further comprising a footing for at least one pair of said modules, with which they are associated by way of adapted connections.

* * * * *